United States Patent [19]

Weber

[11] 4,409,038

[45] Oct. 11, 1983

[54] METHOD OF PRODUCING AL-LI ALLOYS WITH IMPROVED PROPERTIES AND PRODUCT

[75] Inventor: John H. Weber, Sloatsburg, N.Y.

[73] Assignee: Novamet Inc., Wyckoff, N.J.

[21] Appl. No.: 174,181

[22] Filed: Jul. 31, 1980

[51] Int. Cl.[3] ..... C22F 1/04

[52] U.S. Cl. ..... 148/12.7 A; 148/415

[58] Field of Search ..... 148/11.5 P, 12.7 A, 148/32, 32.5

[56] References Cited

U.S. PATENT DOCUMENTS

| | | |
|---|---|---|
| 1,620,081 | 3/1927 | Czochralski et al. . |
| 1,620.082 | 3/1927 | Czochralski . |
| 2,381,219 | 8/1945 | Le Baron . |
| 3,563,730 | 2/1971 | Bach et al. . |
| 3,591,362 | 7/1971 | Benjamin . |
| 3,740,210 | 6/1973 | Bomford et al. . |
| 3,816,080 | 6/1974 | Bomford et al. . |

OTHER PUBLICATIONS

H. K. Hardy, "Trace-Element Effects in Some Precipitation-Hardening Aluminum Alloys", in Journal of the Inst. of Metals, vol. 84, pp. 429-439, 1955-1956.

L. P. Costas and R. P. Marshall, "The Solubility of Lithium in Aluminum", Trans. of the Met. Soc. of AIME, vol. 224, pp. 970-974, Oct. 1962.

Rare Metals Handbook, 2nd Ed., pp. 249-263, 1967.

Z. A. Sviderskaya and V. I. Kuz'mina, "Properties of Al-Li Alloys", Soviet J. Non-Ferrous Metals, vol. 9, #2, pp. 115-118, Feb. 1968.

I. N. Fridlyander et al., "New Light Alloys of Aluminum With Lithium and Magnesium", Nonferrous Metals and Alloys, pp. 211-212, Mar. 1968.

B. Noble and G. E. Thompson, "Precipitation Characteristics of Aluminum-Lithium Alloys", Metal Science Journal, vol. 5, pp. 114-120, 1971.

G. E. Thompson and B. Noble, "Precipitation Characteristics of Aluminum-Lithium Alloys Containing Magnesium", Jnl. of the Inst. of Metals, vol. 101, pp. 111-115, 1973.

T. H. Sanders and E. S. Balmuth, "Aluminum-Lithium Alloys: Low Density", Metal Progress, pp. 32-37, Mar. 1978.

Charles T. Post, "New Aluminum Alloys Ready to Muscle in on Titanium", Iron Age, pp. 41-43, Jul. 3, 1978.

Craig Covault, "Aluminum Study Funds Sought", Aviation Week & Space Tech., pp. 14-15, Jul. 31, 1978.

Chem. Abst., vol. 66, 78565v, (1967).

*Primary Examiner*—R. Dean

*Attorney, Agent, or Firm*—Miriam W. Leff; Raymond J. Kenny

[57] ABSTRACT

A method is provided for producing dispersion-strengthened mechanically alloyed Al-Li alloys with improved mechanical properties. The method comprises subjecting mechanically alloyed, degassed, consolidated Al-Li powders consisting essentially of from above 1.5% up to about 3.5% lithium from about 0.4% up to about 1.5% oxygen, from about 0.2% up to about 1.2% carbon and the balance essentially aluminum, to a heat treatment which will produce an aging response in the alloy.

14 Claims, No Drawings

METHOD OF PRODUCING AL-LI ALLOYS WITH IMPROVED PROPERTIES AND PRODUCT

This invention relates to a powder metallurgy method for producing aluminum-base alloys. More particularly it pertains to a method of producing a dispersion strengthened mechanically alloyed Al-Li alloy system which is characterized by high strength, high specific modulus, high corrosion resistance and thermal stability, and the alloy produced by this method.

BACKGROUND OF THE INVENTION

There is presently a demand in the aircraft industry for aluminum alloys which have high strength, high elastic modulus, low density and high corrosion resistance. For example, alloy 7075, a precipitation hardened alloy, is one of the current standards of the industry for various purposes. Aluminum alloys of higher strength and higher corrosion resistance than alloy 7075 are being sought, particularly for advanced designs. Because of the potential that the addition of lithium offers for improving properties of aluminum with respect to density and elastic modulus, several Al-Li containing alloy systems are presently under study. For example, F. T. Sanders and E. S. Balmuth have reported on three experimental alloys in "Metal Progress", pp. 32–37 (March 1978), viz. Al-Li containing 2.83 and 2.84 w/o (weight %) Li, Al-Cu-Li containing 1.5 w/o Li, and Al-Mg-Li containing 1.37 to 3.14 w/o Li. These alloys, which appear to be formed by "ingot metallurgy", i.e. from a melt, rely for their strength on the precipitation of the δ' phase, $Al_3Li$. The δ' phase coarsens at elevated temperature and transforms to the less effective incoherent δ phase, from the standpoint of strength of the alloy. It has been reported that the δ' phase is known to coarsen rapidly at temperatures of about 200° C. Furthermore, Al-Li alloys made by an ingot route suffer from severe oxidation during melting, and it is difficult to break down the ingot from the cast state during subsequent working.

It has now been found that high strength, high specific modulus, dispersion strengthened Al-Li alloys which have improved mechanical properties can be made by a powder metallurgy technique known as mechanical alloying.

The mechanical alloying technique has been disclosed, for example, in U.S. Pat. Nos. 3,591,362; 3,740,210 and 3,816,080. These patents are incorporated herein by reference. Mechanical alloying, as described in the aforesaid patents, is a method for producing composite metal powders with a controlled, uniform fine microstructure. It occurs by the fracturing and rewelding of a mixture of powder particles during high energy impact milling, e.g., in an Attritor Grinding Mill. The process takes place entirely in the solid state. The repetitive cold welding and fracturing of the powder particles during mechanical alloying of the aluminum incorporates dispersoid materials, such as, for example, the naturally occurring oxides on the surface of the powder particles, into the interior of the composite powder particles. As the process continues the repetitive welding and fracturing of the powder particles, the incorporated dispersoid particles are homogeneously dispersed throughout the powder particles. In a similar fashion metallic alloy ingredients also are finely distributed within the powder particles. The powders produced by mechanical alloying are subsequently consolidated into bulk forms by various well known methods such as hot compaction followed by extrusion, rolling or forging.

U.S. Pat. Nos. 3,740,210 and 3,816,080 are specifically directed to mechanically alloyed aluminum systems and they disclose that one or more elements, among them Li, can be incorporated in the alloy system. By way of example, the patents mention that up to 1.5% lithium can be added. Various solubility limits of Li in Al at room temperature have been reported, e.g. 0.6, 0.7 and 1.5%. In the alloy system of the present invention, more than 1.5% is present, and there is lithium available over the solubility limit. Alloys of the present system have been found to have high strength, high specific modulus, excellent corrosion resistance, and thermal stability to the extent that the room temperature strength is not significantly degraded by cycling to elevated temperatures and back to room temperature.

The present invention enables the production of such alloys with improved properties. For example, alloys can be produced with an improved combination of strength and ductility.

BRIEF DESCRIPTION OF INVENTION

Generally speaking, the present invention is directed to a method for producing a dispersion strengthened Al-Li alloy having high strength, a high specific modulus, and characterized by improved mechanical properties. One aspect of the invention resides in providing an age-hardened dispersion-strengthened Al-Li alloy having improved high tensile strength and ductility. Such method comprises subjecting a degassed, compacted powder, said compact having been formed from a mechanically alloyed dispersion strengthened aluminum-lithium powder having a composition consisting essentially, by weight based on the consolidated product, of a least 1.5% up to about 3.5% Li, about 0.4% up to about 1.5% O, about 0.2% up to about 1.2% C, and the balance essentially aluminum to a heat treatment which produces an age hardening response. The heat treatment comprises a solution treatment and an age hardening treatment. The solution treatment is carried out at a temperature which does not exceed the maximum degassing and/or compaction temperature, i.e. it is carried out at a temperature below the liquation temperature. Preferably, the heat treatment comprises a solution treatment at a temperature of about 400° up to about 540° C. (about 750°–1000° F.) for sufficient time to bring the alloy to temperature up to about 4 hours and an age hardening treatment at about 95° up to about 260° C. (about 200°–600° F.) for about 1 up to about 48 hours. Between the solution treatment and age hardening treatment the alloy is cooled. More preferably, the heat treatment comprises a solution treatment at a temperature of about 400° C. up to about 540° C. for about ½ to about 4 hours followed by age hardening at an elevated temperature, e.g., at a temperature of about 120° C. to about 230° C. for about 1 to 24 hours. The time element bears an inverse relationship to temperature of both solution treatment and age hardening.

As indicated above, the alloy is prepared by mechanical alloying, a high energy impact milling process, and as disclosed in the aforementioned patents U.S. Pat. Nos. 3,740,210 and 3,816,080 and the high energy impact milling is carried out in the presence of a process control agent. After degassing and consolidation, the consolidated material is subjected to the above described heat treatment which produces an aging response in the alloy.

The production of an aging response in mechanically alloyed Al-Li alloys in the present composition range was not a certainty because of e.g., limited information on the system and inconsistencies in reported information. For example, there is some measure of debate about lithium solid solubility in aluminum, there is uncertainty about the effects of impurities on the system, and there is uncertainty on the effect of mechanical alloying on the sensitivity of the alloy to aging. More particularly, the sensitivity of lithium solubility (and thus the precipitation reaction) to alloy purity and minor alloying additions has not been well defined, and the effect of mechanical alloying processing and the effect of the inclusion of a process control agent—factors which control the resultant level and composition of insoluble fine dispersoids and their distribution—on precipitation reactions in the present alloys were, heretofore, unknown.

PREFERRED EMBODIMENTS OF INVENTION

A. Composition & Microstructure

The essential components of the dispersion strengthened aluminum-base alloy system of the present invention are aluminum, lithium, oxygen and carbon. A small percentage of these components are present in combination as insoluble dispersoids, such as oxides and/or carbides. Other elements, e.g. magnesium, iron and copper may be incorporated in the alloy matrix, e.g. for additional strengthening, so long as they do not interfere with the desired properties of the alloy for a particular end use. Similarly, additional insoluble, stable dispersoid agents may be incorporated in the system, e.g. for high temperature strengthening of the system at elevated temperatures, so long as they do not otherwise adversely affect the alloy.

Lithium is present in an amount of at least about 1.5 up to about 3.5 w/o and preferably in an amount of above 1.5 w/o, e.g. about 1.51 w/o, or above 1.7 w/o, e.g. about 1.71 w/o, up to about 2.8 or 3.0 w/o. The lithium is present in an amount which exceeds its solubility limit in aluminum at room temperature, and a small fraction of lithium may be present as a stable insoluble oxide which forms in-situ during mechanical alloying and/or consolidation and is uniformly distributed in the alloy matrix as a dispersoid. Above about 2.8 w/o, e.g., at about 3% or possibly 3.5% there is the possibility with heat treatment of forming extensive amounts of lithium-containing intermetallic precipitates such as $\delta'$ and the alloy may tend to become brittle. Any additional strength gained does not compensate for the loss in ductility, nor is additional strength needed for many applications. The lithium in the present system includes: (a) up to about 1.5 w/o lithium capable of being in equilibrium solution, (b) up to less than about 2.0 w/o of lithium believed to be in supersaturated solution, and (c) an amount of lithium which may tie up oxygen as dispersoid, e.g. about 0.03 to 0.5 w/o lithium, depending on the available oxygen content of the powder charge and total Li content.

The lithium is introduced into the alloy system as a powder (elemental or prealloyed with aluminum), thereby avoiding problems which accompany the melting of lithium.

The oxygen level is about 0.4 w/o up to about 1.5 w/o, preferably about 0.4 to about 1.0 w/o. The oxygen content should be sufficient to provide enough dispersoid for the desired level of strength without being so high as to reduce the lithium content in solution below the solubility limit, taking into account the lithium capable of being in supersaturated solution. When the Li level is at the low end of the range, e.g about 1.6 w/o Li, the oxygen level may range to about 1.5 w/o, and when the Li level is high, e.g. 2.3 to 3.0 w/o, the oxygen level is preferably lower than about 1%, e.g. about 0.4 or 0.9 w/o.

The alloy may also contain up to about 1 w/o magnesium and up to about 0.3 or 0.5 w/o iron.

The carbon level is about 0.2 w/o up to about 1.2 w/o, preferably about 0.25 to about 1.0 w/o. The carbon is generally provided by a process control agent. Preferred process control agents are methanol, stearic acid, and graphite.

The dispersoid comprises oxides and carbides present in a range of a small but effective amount for increased strength up to about 6 v/o (volume %) or even as high as 8 volume %. Preferably the dispersoid level is as low as possible consistent with desired strength. Typically the dispersoid level is about 3 to 5 v/o. The dispersoid may be present, for example, as an oxide of aluminum or lithium. The dispersoid can be formed during the mechanical alloying step and/or later consolidation and thermomechanical processing. Possibly they may be added as such to the powder charge. Other dispersoids may be added or formed in-situ so long as they are stable in the aluminum-lithium matrix at the ultimate temperature of service. Examples of dispersoids that may be present are $Al_2O_3$, AlOOH, $Li_2O$, $Li_2AlO_4$, $LiAlO_2$, $LiAl_5O_8$, $Li_5AlO_4$, $Li_2O_2$ and $Al_4C_3$.

The size of the dispersoid is very fine, e.g., it may be of the order of about 0.02 $\mu$m, and it is uniformly dispersed throughout the alloy powder. It is believed the fine grain size of the alloy which is of the order of about 0.1 $\mu$m, is at least in part, responsible for the high room temperature strength of the alloy.

B. Alloy Preparation (1) Mechanical Alloying

Powder compositions treated in accordance with the present invention are all prepared by a mechanical alloying techique. This technique is a high energy milling process, which is described in the aforementioned patents incorporated herein by reference. Briefly, aluminum powder is prepared by subjecting a powder charge to dry, high energy milling in the presence of a grinding media, e.g. balls, and a process control agent, under conditions sufficient to comminute the powder particles to the charge, and through a combination of comminution and welding actions caused repeatedly by the milling, to create new, dense composite particles containing fragments of the initial powder materials intimately associated and uniformly interdispersed. Milling is done under an argon or nitrogen blanket, thereby facilitating oxygen control since virtually the only sources of oxygen are the starting powders and the process control agent. The process control agent is a weld-controlling amount of a carbon-contributing agent and may be, for example, graphite or a volatilizable oxygen-containing hydrocarbon such as organic acids, alcohols, heptanes, aldehydes and ethers. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. The process control agent is added at various times during the run based on ball-to-powder ratio, starting powder, size, mill temperature, etc. As indicated above, preferable process control agents are form appears to be less effective for producing high modulus. Only minimal effect of heat treatment is seen for the 1.9 w/o lithium sample (Sample B) apparently because the lithium content is only slightly above the solubility limit and aging is limited.

From the above tests it appears that the heat treatment is beneficial for alloys containing more than about 1.9% lithium to the extent that an alloy of higher thermal stability and tensile strength can be obtained. Aging treatments at lower temperatures are expected to produce benefits in Al-Li alloys with lower lithium contents, viz. about 1.7–1.8 w/o.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method for producing a dispersion-strengthened aluminum-base alloy of improved mechanical and thermal properties comprising degassing and compacting at elevated temperature below liquation temperature a mechanically alloyed powder consisting essentially of aluminum, lithium, oxygen and carbon, and optionally one or more of the group selected from magnesium, copper and iron, the lithium level being at least about 1.7 up to about 3.5 weight %, the dispersoid comprising the carbon and oxygen, and being present in a small but effective amount for increased strength up to about 8 volume %, and the balance, apart from said optional components, essentially aluminum, and subjecting the compacted powder to a solution treatment at a temperature not exceeding the maximum degassing and/or compaction temperature, cooling the solution treated alloy, and aging the alloy at an elevated temperature for a period of time sufficient to permit age hardening of the alloy.

2. A method according to claim 1, wherein solution treatment is carried out at substantially the same temperature as the compaction temperature.

3. A method according to claim 1, wherein degassing and/or compaction is carried out at a temperature from about 400° C. to about 510° C. and solution treatment is at a temperature from about 400° C. to 510° C. for sufficient time to bring the alloys to temperature up to about 4 hours.

4. A method according to claim 1, wherein cooling from the solution treatment temperature is by water quenching.

5. A method according to claim 1, wherein aging is effected at a temperature in the range of about 95° C. to about 260° C. for about 1 to about 48 hours.

6. A method according to claim 1, wherein aging is effected at a temperature in the range of about 120° C. to about 230° C. for about 1 to about 24 hours.

7. A method according to claim 1, wherein compaction is carried out at 510° C., solution treatment at about 510° C. for about 0.5 hours, and aging at about 177° C. for about 1 to about 4 hours.

8. A method according to claim 1, wherein the mechanical alloyed dispersion strengthened powder has on compaction a composition consisting essentially of, by weight, from about 1.7 up to about 3.5% lithium, from about 0.4% up to about 1.5% oxygen, from about 0.2% up to about 1.2% carbon, and the balance essentially aluminum.

9. A method according to claim 8, wherein the lithium level is about 2.6%.

10. A dispersion strengthened mechanically alloyed aluminum-lithium alloy consisting essentially of, by weight, from about 1.7% up to about 3.5% lithium, from about 0.4% up to about 1.5% oxygen, from about 0.2% up to about 1.2% carbon, and the balance essentially aluminum, said dispersoid being present in a small but effective amount for increased strength up to about 8 volume%, and said alloy being in the solution treated, age hardened condition.

11. A dispersion strengthened mechanically alloyed aluminum-lithium alloy according to claim 10, wherein the dispersoid level is about 3 to about 5 volume %.

12. A heat treated dispersion strengthened aluminum-lithium alloy produced by the method of claim 1.

13. A dispersion strengthened mechanically alloyed aluminum-lithium alloy consisting essentially of, by weight, from about 1.7% up to about 3.5% lithium, from about 0.4% up to about 1.5% oxygen, from about 0.2% up to about 1.2% carbon, and the balance essentially aluminum, said dispersoid being present in a small but effective amount for increased strength up to about 8 volume %, and said alloy being in the solution treated, age hardened condition and having a grain size of the order of 0.1 μm.

14. A dispersion strengthened mechanically alloyed aluminum-lithium alloy consisting essentially of, by weight, from about 1.7% up to about 3.5% lithium, from about 0.4% up to about 1.5% oxygen, from about 0.2% up to about 1.2% carbon, and the balance essentially aluminum, with the proviso that the oxygen content is sufficient to provide enough dispersoid for the desired level of strength without being so high as to reduce the lithium content in solution below the solubility limit, said dispersoid being present in a small but effective amount for increased strength up to about 8 volume %, and said alloy being in the solution treated, age hardened condition.

* * * * * methanol, stearic acid, and graphite. Carbon from these organic compounds and/or graphite is incorporated in the powder and contributes to the dispersoid content.

(2) Degassing and Consolidation

Before the dispersion strengthened mechanically alloyed powder is consolidated by a thermomechanical treatment, it must be degassed. A separate compaction step may or may not be used. Degassing and compacting are carried out at a temperature below liquation temperature, typically at a temperature of about 220° to about 600° C., consolidated at about 220° to about 600° C., and preferably at about 500° C. One preferred powder consolidation practice is to can, high temperature degas, e.g. at 510° C. (950° F.), hot compact and extrude at about 315° to about 510° C. (600°-950° F.).

It is believed that the preferred conditions produce an alloy which is strengthened by an extremely fine grain size, a high dislocation density, and a fine uniform dispersion of oxygen-containing and carbon-containing compounds. A contribution to strength related to lithium is caused by solid solution strengthening and precipitation hardening. The lithium present also contributes to the high specific modulus.

(3) Heat Treatment

The heat treatment consists of two steps: viz. a solution treatment and an aging treatment as described above. Between the solution treatment and age hardening treatment the alloy is cooled. Cooling may be carried out, for example, by air cooling, water quenching, oil quenching, etc.

In addition to high strength, low density and high elastic modulus, the dispersion strengthened alloy has excellent corrosion resistance, excellent stress corrosion cracking resistance, and thermal stability.

The invention is further described, but not limited to the illustrative examples which follow.

EXAMPLE I

Samples of Al-Li alloys in the range of the present invention were subjected to a number of heat treatments after consolidation to determine the effect of such treatments on the hardness of the aluminum-lithium alloy. The heat treatments consists of a solution treatment at the previous degas and consolidation temperature, viz. 510° C. (950° F.). This solution treatment was for 0.5 hour followed by water quench and then an age hardening treatment at 177° C. (350° F.) for various periods between 0 and 16 hours. The alloy was air cooled after aging and hardness (Rockwell B scale) data were obtained at room temperature. The samples subjected to these heat treatments had previously been prepared from dispersion-strengthened, mechanically alloyed aluminum-lithium mixtures of powders (formed in a high energy impact mill for 4 hours at a ball:powder weight ratio of 40:1 under a blanket of argon and in the presence of a process control agent (PCA). The powders were canned, vacuum gassed for 3 hours, then compacted at 510° C. (950° F.), and extruded to ⅝" rod at a temperature of 343° C. (650° F.). Compositions of two samples (samples A and B) are shown in Table I and the data obtained after heat treatment are shown in Table II.

TABLE I

| Sample | Composition, w/o | | | |
|---|---|---|---|---|
| | Li | O | C | Fe |
| A | 2.6* | 1.13* | 0.49 | 0.06 |

TABLE I-continued

| Sample | Composition, w/o | | | |
|---|---|---|---|---|
| | Li | O | C | Fe |
| B | 1.93 | 0.45 | 0.26 | 0.08 |

*Analysis of chips from extruded rod - other analysis are of the powder

TABLE II

| Sample | Aging Time (Hours) | Hardness, $^{R}B$ |
|---|---|---|
| A | 0 (solution treated only) | 79.5 |
| | 1 | 85.5 |
| | 4 | 83.5 |
| | 16 | 78.0 |
| B | 0 (solution treated only) | 70.5 |
| | 1 | 69.0 |
| | 4 | 71.5 |
| | 16 | 65.0 |

The data in Table II show that at a lithium level of 2.6 w/o (sample A), there is a significant aging response with heat treatment at 177° C. (350° F.). Only minimal effect of heat treatment is seen for the 1.9 w/o lithium sample (Sample B) apparently because the lithium content is only slightly above the solubility limit and aging is limited. From the above results it appears that the heat treatment produces an aging response which is dependent on the lithium contents of the alloys. One familiar with aging in alloys would expect the extent of the response also to be dependent on the heat treatment (aging) temperature, with lower temperatures producing a greater response albeit at longer exposure times.

EXAMPLE II

Samples of the same two mechanically alloyed Al-Li alloys shown in Example I, which are in accordance with the present invention, were also subjected to specific heat treatments after consolidation to determine the effect of such heat treatments on the strength of the aluminum-lithium alloy. The heat treatments consists of a solution treatment at the previous degas and consolidation temperature, viz. 510° C. (950° F.). This solution treatment was for 0.5 hour followed by water quench and then an age hardening treatment at 177° C. (350° F.). Sample A (2.6 w/o lithium) was age hardened for 1 hour at 177° C. (350° F.), while Sample B (1.9 w/o lithium) was heat treated for 4 hours at 177° C. (350° F.). The alloys are then air cooled and tensile data obtained at room temperature.

Data obtained on Samples A and B after heat treatment are compared with data obtained in the "as extruded" condition in Table III. The room temperature data in Table II are ultimate tensile strength (UTS), yield strength (YS), % elongation (% El), % reduction of area (% RA) and elastic modulus (E).

TABLE III

| Sample | Condition | YS (ksi) | UTS (ksi) | El (%) | RA (%) | E ($10^6$ psi) |
|---|---|---|---|---|---|---|
| A | As Ext. | 67.5 | 76.5 | 2.0 | 6.0 | 11.6 |
| | Heat Trtd. | 82.5 | 88.8 | 2.5 | 7.5 | 11.0 |
| B | As Ext. | 55.1 | 58.5 | 13.0 | 38.5 | 11.7 |
| | Heat Trtd. | 55.3 | 59.6 | 10.0 | 29.0 | 11.3 |

The data in Table III show that at a lithium level of 2.6 w/o (Sample A) there is a significant benefit to strength with heat treatment and this is indicative of age hardening of the alloy. There is a decrease in modulus after heat treatment, thus the lithium in precipitated